United States Patent [19]

Krulwich

[11] 4,232,460

[45] Nov. 11, 1980

[54] MAGNETIC PRESS AND REFRESHER FOR CLOTHES

[76] Inventor: Lester S. Krulwich, 241 Central Park West, New York, N.Y. 10024

[21] Appl. No.: 940,906

[22] Filed: Sep. 11, 1978

[51] Int. Cl.[3] ..... D06F 69/00

[52] U.S. Cl. ..... 38/1 R; 38/17

[58] Field of Search ..... 38/1 R, 17, 19, 69, 38/71, 72; 220/230

[56] References Cited

U.S. PATENT DOCUMENTS

| | | | |
|---|---|---|---|
| 796,471 | 8/1905 | Tenent | 38/71 |
| 1,310,297 | 7/1919 | Rosier | 38/71 X |
| 1,486,433 | 3/1924 | Hogan | 38/71 |
| 1,651,884 | 12/1927 | Goodfellow | 38/17 |
| 2,709,861 | 6/1955 | Reed | 38/71 |
| 2,932,545 | 4/1960 | Foley | 220/230 X |
| 4,045,291 | 8/1977 | Berger | 220/230 X |

FOREIGN PATENT DOCUMENTS

| | | | |
|---|---|---|---|
| 740863 | 2/1933 | France | 38/71 |
| 743967 | 4/1933 | France | 220/230 |

*Primary Examiner*—Louis Rimrodt

[57] ABSTRACT

A magnetic press and refresher for clothes in the form of a flat central member, preferably rectangular, containing magnetic tapes attached adjacent to its longitudinal edges on both surfaces with backings similarly sized having magnetically attractable strips on the longitudinal sides of one surface aligned with the magnetic tapes on the central member. The backings may consist of transparent material and said strips are capable of being raised from or lowered to the surface of the backings. Clothing moistened, optionally with a slight solution of mild cleaning material, is set on the central member between the magnetic tapes or on a backing or both backings between the strips. The central member and backing or backings are then joined together by the tapes magnetically adhering to the strips and afterwards separated.

5 Claims, 7 Drawing Figures

MAGNETIC PRESS AND REFRESHER FOR CLOTHES

This invention relates to improvements in apparatus for a magnetic press and refresher for clothes. When you have been out in the rain or have spent a fairly active day your trousers, slacks and other clothes often need pressing and refreshing. You generally either pull out the ironing board and iron or send the clothing to a tailor. The available alternatives are cumbersome, mechanically complex, expensive or impractical.

An important object of this invention is to provide a magnetic press that presses trousers, slacks, shirts, neckties and other clothing in a few minutes.

Another object of this invention is to provide a magnetic press that readily removes wrinkles from and creases clothes and is inexpensive to make.

Another object of this invention is to provide a magnetic press capable of pressing and refreshing clothes quickly that is easy to operate and is portable.

Another object of this invention is to provide a magnetic press for clothes that operates efficiently without electricity or steam, without complicated or cumbersome mechanism and is not apt to get out of order or break.

Another object of this invention is to provide a magnetic press capable of pressing and refreshing a variety of clothes simultaneously.

Further objects and structural details of the invention will be apparent from the following description when read in conjunction with accompanying drawings forming a part of this specification, wherein.

Figure 1:
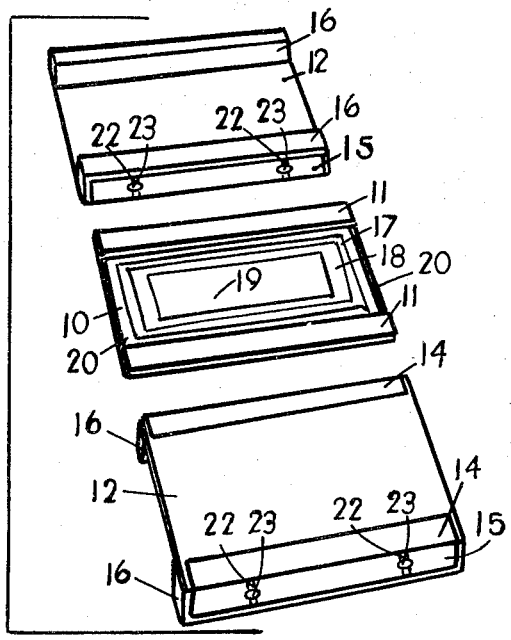
FIG. 1 is a perspective view of an embodiment of my invention with the central member and two backings not joined together, and the outside fastening and extra magnets omitted.
Figure 2:
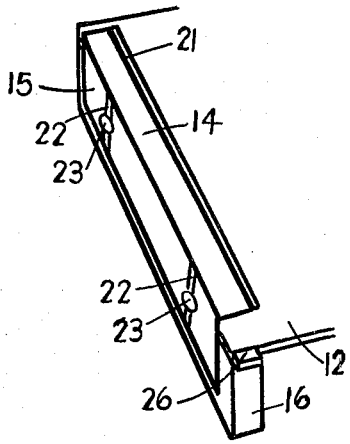
FIG. 2 is a perspective view of the longitudinal side of a backing showing the strip raised, the holding screws against the slots and one of the extra magnets.
Figure 3:
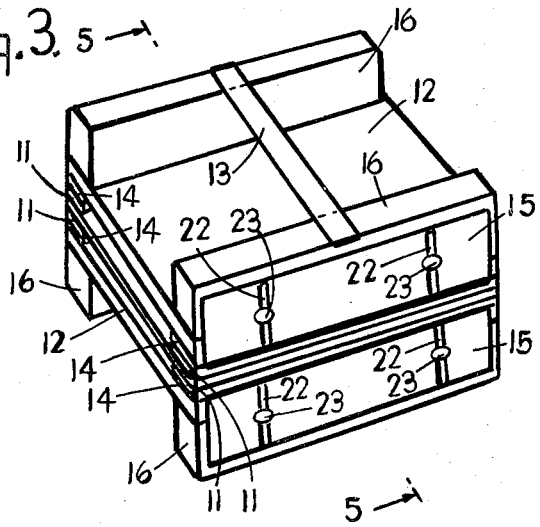
FIG. 3 is a perspective view with a backing joined to each side of the central member.
Figure 4:
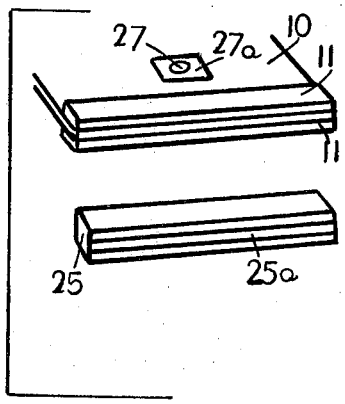
FIG. 4 is a frontal perspective view of parts of the central member showing tapes on a longitudinal side of both surfaces, also additional flexible members.
Figure 5:
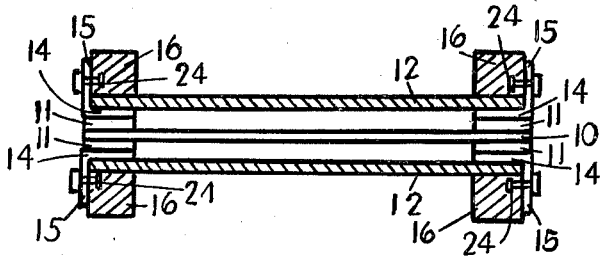
FIG. 5 is an enlarged section on line 5—5 of FIG. 3. Front section views show the tapes lowered, their surfaces even with the surfaces of the rectangular member and backing.
Figure 6:
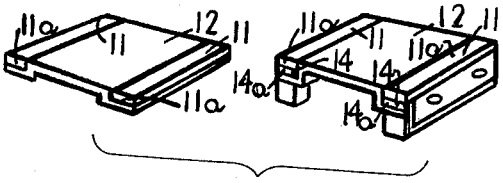
FIG. 6 shows perspective views of the lowered surfaces to which the tapes are attached, with the surfaces of the tapes even with the surfaces of the rectangular member and backing.
Figure 7:
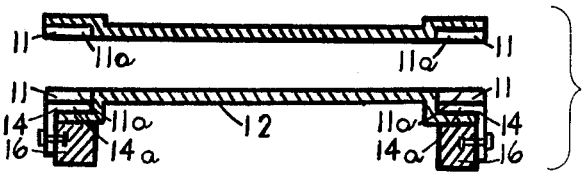
FIG. 7 is a section similar to FIG. 5 of the rectangular member and backing showing the tapes lowered so that their surfaces are even with the surfaces of the rectangular member and backing.

Upon reference to the drawings in detail, they show a magnetic press and refresher for clothes comprising a flat, nonabsorbent central member 10, preferably magnetically attractable, rectangular and partially flexible, having flexible magnetic rubber tape 11 attached adjacent to its longitudinal edges on both surfaces. A relatively thin, flat backing 12 is provided preferably for each side of the central member 10 with outside adjustable fastenings 13. The backings 12 or central member 10 or both may optionally consist of transparent material. Magnetically attractable strips 14 are movably set on the longitudinal sides of the backings 12, on the surfaces that face the central member 10. The strips 14 bend down right angularly along the edges of said longitudinal sides with the bent down portions 15 adjustably engaging an extension 16 fastened to the other side of each backing 12 adjacent to their edges and with the strips 14 capable of being raised or lowered to the surfaces of the backings 12. Disposable nonabsorbent 17 and absorbent 18 sheets are preferably placed on the central member 10 and a backing 12. The clothing 19, preferably moistened, optionally with a slight solution of mild cleaning material, is set on the central member 10 between the magnetic tapes 11 or on a backing 12 or both backings between the strips 14. The central member 10 and the backing 12 are then joined by the flexible magnetic rubber tape 11 adhering to the magnetically attractable strips 14 on the backing 12. The other backing 12 may then or at the same time be similarly employed with clothing 19 between it and the other side of the central member 10. Additional central members may be similarly employed.

The central member 10 is large enough, for example 18 by 15 inches, to cover the main leg portions of most slacks, trousers, sleeves, neckties and other articles. The material of the central member 10 is preferably magnetically attractable, such as galvanized sheet iron with the narrower edges slightly hemmed 20. The magnetic rubber tapes 11 slightly overlap the adjacent edges of both surfaces of the central member 10. They may be synthetic or of other composition. They are flat, thin and sufficiently wide, for example 1/16 inch thick and one inch wide. When the tapes 11 adhere magnetically to the strips 14 on the backings 12 the space between the surfaces of the central member 10 and the backing 12 is sufficiently close for most clothing 19 to be clasped firmly, for example $\frac{1}{8}$ inch pliably yielding to about $\frac{3}{8}$ inch.

The backings 12 are about the same rectangular size as the central member 10 and of suitable material, preferably light, such as $\frac{1}{8}$ inch plywood or aluminum. They may optionally be transparent, for example acrylic or plexiglass. The magnetically attractable strips 14 are of thin, flat material such as galvanized sheet iron, horizontally about one inch wide and turned 21 slightly downward along their longitudinal edges that face the center of the backing 12. The portions 15, for example about one inch wide, bent downward right angularly, each contain two narrow slots 22, for example $\frac{1}{8}$ inch wide, one towards each longitudinal side, extending down to accommodate holding screws 23 such as thumb screws. The extensions 16 fastened on the other side of the backings 12 are preferably rectangularly elongated and, in line with each slot 22, have nuts 24 inserted in openings, afterwards closed, partly into the inner sides of the extensions 16 and with narrower openings, from the outside, opposite each slot 22 to accommodate the holding screws 23. The horizontal surfaces of the strips 14 may thereby rest on the backings 12 flat, be raised or lowered.

An additional flexible member 25 is optionally provided containing a plurality of removable layers 25*a* of thin magnetic tapes similar to the magnetic tapes 11 fastened on the central member 10 and about the same length. The layers 25*a* are each capable of adhering to central member tapes 11 or surfaces or to the backing strips 14, further increasing the space for clothing 19 or blocking out certain pressing areas.

One central member 10 has been illustrated and described but more than one may be employed between the backings 12 with the clothes 19 also similarly placed between the central members 12. One backing 12 may be dispensed with and in that case the central member 10 need only have tapes 11 on the surface facing the other backing 12. Adjustable fastenings 13, such as reinforced overlapping strips of magnetic rubber tape or Velcro, are removably attached to the backings 12 or a backing 12 and the central member 10 as an extra holding means and if desired to increase the pressure. For portability the backings 12 and the central member 10 or members may be cut longitudinally midway into two sections and removably fastened from the back by hinges, magnetic tape or other suitable means and before pressing rejoined as they were originally.

For still more magnetic adhesion magnets 26 may be attached at the ends of the extensions 16 attracting the magnetically attractable central member 10. Minimizing the space may sometimes be desirable, such as for lace or kerchiefs, and optionally the surfaces of the tapes 11*a* and the strips 14*a* may be set even with the surfaces of the central member 10 and backing 12 by lowering their base. Also the position of the tapes 11 and strips 14 may optionally be altered or interchanged.

OPERATION OF THE APPARATUS

To operate the device only one of the backings 12 has to be used but it is better to removably fasten the other backing 12 anyway for added compactness. The disposable nonabsorbent sheets 17, for example wax paper, are placed on the central member 10 between the magnetic rubber tapes 11 and on the backing 12 between the strips 14, and over these the disposable absorbent sheets 18, for example paper toweling or white blotter sheets. The articles of clothing 19 such as the leg and crease portions of slacks and trousers or neckties, are moistened with warm or cool water, the water optionally containing a relatively mild and small amount of a cleaning element, such as pinches of sodium carbonate and white ivory soap. The clothing 19 is then spread on the absorbent sheet 18, on either the central member 10 or a backing 12 and is folded if and where creases are desired. The central member 10 and a backing 12 are then magnetically lapped together. The backings 12 preferably have a water repellent finish but the nonabsorbent sheets 17 are used to confine the absorbtion and avoid cleaning the parts afterwards.

The magnetic rubber tapes 11 are uniquely useful here because when elongated they become especially powerful magnetically. Not only do they removably grip magnetically attractable material instantly and strongly but also magnetically attract when more than about ¼ inch away tending to adhere when ordinary clothes 19, not too thick, are between parts of the central member 10 and a backing 12. Thus the clothing 19 may extend partly over the sides.

The slight pliability of the central member 10 and the backings 12 permits pressing in most cases with the strips 14 down flat on the backings 12 but the slots 22 and holding screws 23 provide for an extra ½ inch of clothing space and can easily be structured for more space if needed. Setting the nuts 24 back from the slot 22 sides of the extensions 16 and the narrow screw openings enables the nuts 24 to withstand the outward pull of the holding screws 23. Other suitable means may be employed for adjusting the clothing space. The layers 25*a* of magnetic tape on the additional flexible member 25 can be useful here, besides helping to block out any area not being pressed. When clothing 19 is not inserted between the central member 10 and one of the backings 12 padding may be inserted there for extra pressure on certain parts.

The device presses clothing 19 with surprising smoothness and neatness and ordinarily need be closed only a few minutes to accomplish satisfactory results. Pressing after water moistening and setting on the absorbent sheet 18 refreshes the clothes but the small amount of cleaning element may be mixed in the water. Clothes 19 may be pressed with this device after machine washing but if detergents have been used before insertion the detergents should be rinsed out before pressing. Also it may be desirable to wipe some clothes being refreshed with a damp cloth. The clothes 19 lastingly retain their press afterwards and if moistened only slightly before insertion they can be worn right after pressing.

Smaller sizes of the device may be used, not only for small clothing, but the pressing can be continuous, rejoining and separating the central member 10 and the backing 12 and slightly overlapping on the clothes 19 each time. Especially if a single backing 12 is used a knob 27 with a magnetic base 27*a* can be handy on the outside of the magnetically attractable central member 10 or on a backing 12 with a magnetically attractable piece fastened on the backing 12.

I have described preferred embodiments of my invention, but it is understood that various changes may be made in the form, details, arrangements and proportions of the various parts without departing from the scope of my invention.

What I claim is:

1. A magnetic press and refresher for clothes apparatus comprising a flat, thin rectangular member, partially pliable, containing thin, flat flexible magnetic tape attached adjacent to each of the longitudinal edges of its surface, the base of said tapes being lowered so that their surfaces are even with the surface of said rectangular member, and a flat, thin backing of the same size as said rectangular member, provided with magnetically attractable strips movably set on each of the longitudinal sides of said backing on a base lowered from its surface, with said strips adjustably engaging extensions fastened to the other side of said backing enabling said strips to be raised and lowered from the surface of said backing, and capable of magnetically adhering on said magnetic tapes, thereby holding clothes placed between said backing and rectangular member and allowing said clothes to extend out on all sides.

2. A magnetic press and refresher for clothes apparatus according to claim 1, said backing provided with thin, flat flexible magnetic tape attached on each of said strips with the longitudinal sides of said backing indented sufficiently so that the surface of said tapes can be set level with the surface of said backing, said tapes being aligned with the magnetic tapes on the rectangular member so as to be capable of adhering magnetically and instantly on them with clothes between said rectangular member and said backing.

3. A magnetic press and refresher for clothes apparatus according to claim 2, the opposite surfaces of said flat rectangular member and backing each provided with a disposable nonabsorbent sheet covered by a disposable absorbent sheet, with the clothes being moistened before insertion, and said disposable absorbent sheets thereby substantially absorbing and removing the moisture from the inserted clothes when said rectangular member and backing are joined together.

4. A magnetic press and refresher for clothes apparatus according to claim 2, said rectangular member and backing substantially consisting of transparent material so as to be capable of revealing possible wrinkles in the inserted clothes.

5. A magnetic press and refresher for clothes apparatus according to claim 2, structured sufficiently thin, flat and light so as to be conveniently portable and insertable with clothes in conventional luggage.

* * * * *